United States Patent [19]

Skogward

[11] Patent Number: 4,660,482

[45] Date of Patent: Apr. 28, 1987

[54] SEWING MACHINE THREAD TAKE-UP LEVER

[75] Inventor: Kenneth O. E. Skogward, Huskvarna, Sweden

[73] Assignee: Husqvarna Aktiebolag, Sweden

[21] Appl. No.: 819,639

[22] Filed: Jan. 17, 1986

[30] Foreign Application Priority Data

Jan. 29, 1985 [SE] Sweden ..... 8500404

[51] Int. Cl.[4] ..... D05B 49/02

[52] U.S. Cl. ..... 112/241; 74/54

[58] Field of Search ..... 112/241, 248, 96, 57, 112/247; 74/54, 569

[56] References Cited

U.S. PATENT DOCUMENTS

| | | | |
|---|---|---|---|
| 2,438,636 | 3/1948 | Ivandick | 112/241 |
| 2,660,088 | 11/1953 | Serra | 74/54 X |
| 2,682,846 | 7/1954 | Bell | 112/241 X |

*Primary Examiner*—Werner H. Schroeder
*Assistant Examiner*—Andrew M. Falik
*Attorney, Agent, or Firm*—Alfred E. Miller

[57] ABSTRACT

A thread take-up lever in a sewing machine in which the driving cam disc of the take-up lever is mounted on the crankshaft driving the needle bar up and down. The driving cam disc is supported on one side while the spacing on the other side can be optimally utilized. This enables a correct position of the thread take-up movement.

4 Claims, 2 Drawing Figures

SEWING MACHINE THREAD TAKE-UP LEVER

BACKGROUND OF THE INVENTION

The present invention relates to an arrangement of a thread take-up lever for the upper thread in a sewing machine.

The purpose of a thread take-up lever is to slacken the upper thread and then to tension it during certain predetermined intervals of the stitch forming procedure. It therefore performs a vertical movement similar to that of the movement performed by the needle bar. Thus, in hitherto known embodiments, the same crank on the upper arm shaft is used for driving the needle bar as well as the take-up lever with the difference that the movement of the latter is delayed by means of an extra link, since the taking up of the upper thread continues after the needle has reached its upper end position. These previous embodiments occupy substantial space in the upper arm, which space is hard to provide in a modern sewing machine having control electronics and stepper motor in the upper arm.

SUMMARY OF THE INVENTION

The present invention provides a take-up lever arrangement in which a driving plate is mounted on the crankshaft that drives the needle bar, and comprises components at the end thereof away from the shaft providing more space for the movement of the take-up lever. The arrangement therewith has eliminated the need for space for links and arms with bearings and transmissions used together as in previous embodiments of take-up levers. The provision of such a driving plate also means that the movement of the take-up lever is timed exactly with regard to the movements of the needle and the loop-taker.

An example of an embodiment according to the invention will be described in the following with reference to the accompanying drawings which shows in

BRIEF DESCRIPTION OF THE DRAWINGS

FIG. 1 an exploded sketch of the take-up lever arrangement and in

DESCRIPTION OF THE PREFERRED EMBODIMENTS

Figure 2:
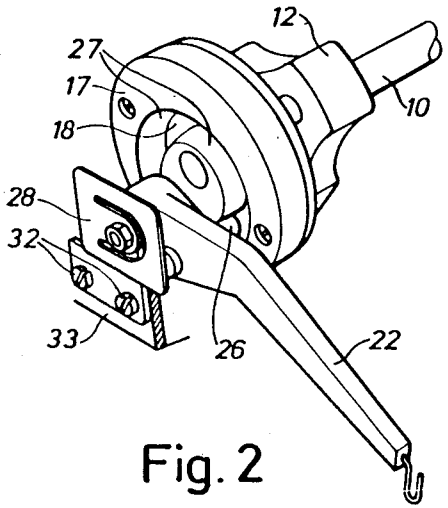
FIG. 2 a perspective view of the take-up lever arrangement.

In the exploded sketch all parts in the arrangement are shown separated in the order in which they then are assembled to a complete embodiment of the take-up lever according to FIG. 2. A shaft 10 with a chamfer 11 is journalled in the machine body and driven by the motor of the machine. The end of the shaft carries a crank 12 with a crank pin 13 which is in driving connection with a center disc 14. The disc 14 has a center pin 15 and a hole 16 for the crank pin. Finally, the end of the shaft has a cam disc 17 which has a cam contour in the form of a circular groove 18 which is eccentrically positioned in the disc. All components on the shaft are held together by screws 19, 20 and are balanced by a counter-weight 21 as a part of the crank which provides equilibrium to the unsymmetrical mass of the cam disc.

Figure 1:
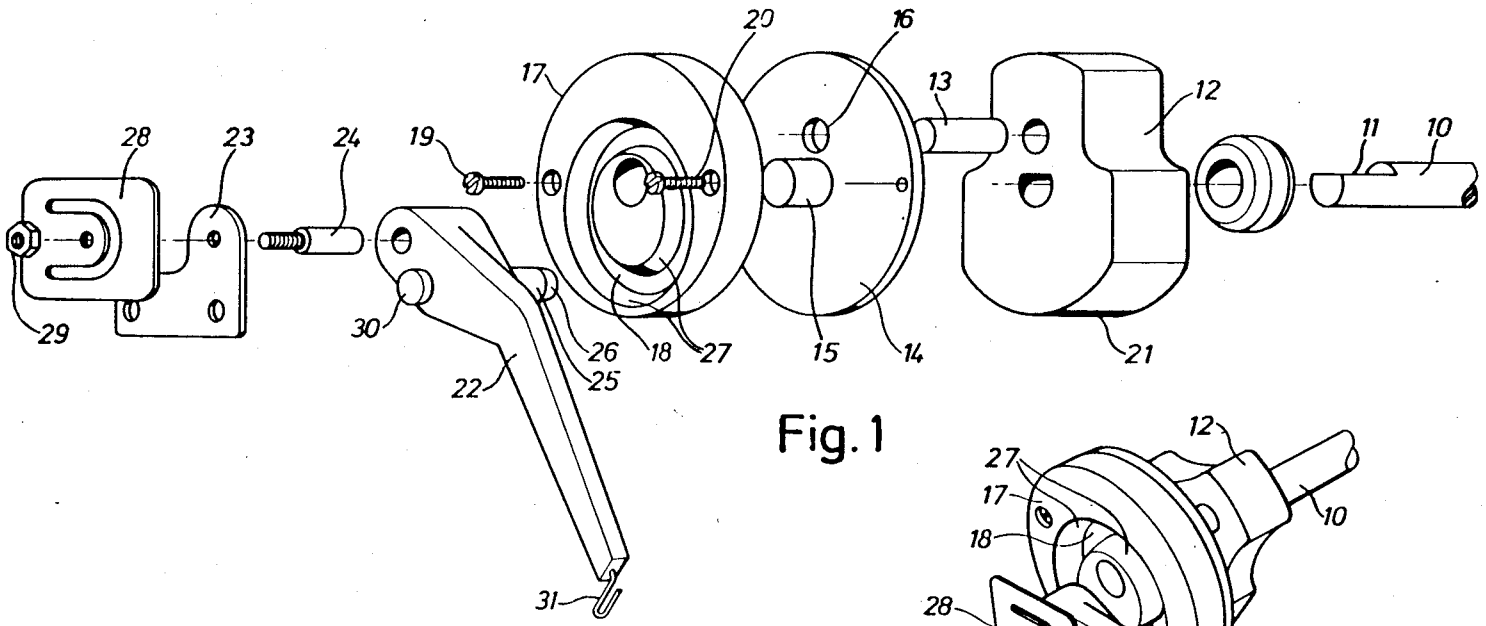

The rest of the components shown to the left in FIG. 1 comprise an arm 22 journalled on a pin 24 secured to a plate 23, and a cam follower 25 which projects into the groove 18. The cam follower has a tapered blunt tip 26 which fits to the chamfered side walls 27 in the groove without reaching the bottom, so that a smooth and tight contact between the curve and its follower is established, when the latter is pressed to the groove disc. The pressure is provided by a blade spring 28 secured in its center below a nut 29 screwed on a threaded end of the pin 24. Then the spring presses against a projecting end 30 of the cam follower 25. During the movement of the arm 22 this projecting end 30 slides on the surface of the blade spring. The outer end of the arm has a hook 31 on which the upper thread is hooked when threading the machine.

In FIG. 2 the arrangement is shown assembled and fastened by screws 32 to a portion 33 of the machine body. The distance between the cam disc 17 and the arm 22 is then so determined that the curve follower abuts the walls 27 of the groove under pressure. When the curve disc rotates, a swinging motion is transferred to the arm without any play or noise. The components can be made with good precision and assembled in a working unit without any need for re-adjustment of positions.

The embodiment described shall be seen as an example of the invention. The arrangement can, of course, be modified as to the design of the components without departing from the inventive idea.

I claim:

1. In a sewing machine having a thread take-up lever mounted for swinging movement about a fixed pivot, the lever having hook means at one end for receiving a thread, a shaft for driving a needle bar, and a cam disk mounted for rotation with said shaft, said cam disk having a face normal to said shaft with a cam groove therein, said take-up lever having a cam follower engage in said groove to impart a swinging motion to said take-up lever, said groove having side walls and a bottom wall; the improvement wherein said side walls are sloped with respect to said shaft whereby said groove has a trapezoidal cross section with the short side thereof along said bottom wall, said cam follower being tapered to fit in said groove to engage the side walls of said groove without contacting said bottom wall and being mounted to said take-up lever between said fixed pivot and said hook means, and further comprising spring means mounted to urge said cam follower into said grooves.

2. The sewing machine of claim 1 wherein said groove is circular and eccentric with respect to the axis of said cam disk.

3. The sewing machine of claim 1 wherein said spring means comprises a blade spring slidably engaging said take-up lever.

4. The sewing machine of claim 1 wherein said fixed pivot comprises a pin fixedly mounted to said sewing machine, said spring means comprising a blade spring mounted to said pin and having a portion slidably resiliently engaging said take-up lever.

* * * * *